US007722396B2

(12) United States Patent
Suzuki et al.

(10) Patent No.: US 7,722,396 B2
(45) Date of Patent: May 25, 2010

(54) SEAL BODY AND CONNECTOR INCLUDING THE SAME

(75) Inventors: Shogo Suzuki, Shizuoka (JP); Kazuki Zaitsu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 231 days.

(21) Appl. No.: 11/979,417

(22) Filed: Nov. 2, 2007

(65) Prior Publication Data

US 2008/0111320 A1 May 15, 2008

(30) Foreign Application Priority Data

Nov. 9, 2006 (JP) ..... 2006-303755

(51) Int. Cl.
*H01R 13/40* (2006.01)

(52) U.S. Cl. ..... 439/587

(58) Field of Classification Search ..... 439/587, 439/589, 274, 275; 174/153 G
See application file for complete search history.

(56) References Cited

U.S. PATENT DOCUMENTS 2,277,637 A * 3/1942 Eby ..... 174/153 G
4,839,471 A * 6/1989 Clark et al. ..... 174/92
5,980,316 A * 11/1999 Shinchi ..... 439/587

FOREIGN PATENT DOCUMENTS

JP 2000-323229 11/2000

* cited by examiner

*Primary Examiner*—Neil Abrams
(74) *Attorney, Agent, or Firm*—Edwards, Angell Palmer & Dodge LLP

(57) ABSTRACT

A connector including seal bodies having an excellent sealing characteristic. The seal body puts an electric wire between the seal body and the other seal body so as to maintain a water-tight characteristic between the electric wire and the seal bodies. The seal body includes: an abutting surface of the seal body, which abuts against a mating abutting surface of the other seal body when the seal bodies overlap each other; a groove which positions the electric wire inside the seal bodies; a lip part which projects from an inner surface of the groove and from the abutting surface.

8 Claims, 9 Drawing Sheets

T1 > T3 , T2 > T3

S1 = S2

SEAL BODY AND CONNECTOR INCLUDING THE SAME

BACKGROUND OF THE INVENTION (1) Field of the Invention

The present invention relates to a connector for use in connection of electric wires and so on, in particular, a connector including: a housing for receiving a terminal fitting attached to an end of an electric wire; and a seal body to maintain a watertight characteristic between an inner surface of the housing and the electric wire.

(2) Description of the Related Art

Various electronic instruments are mounted on a motor vehicle as a mobile unit. The motor vehicle mounts a wiring harness for transmitting electric power and control signals to the electronic instruments. The wiring harness includes a plurality of electric wires and connectors.

As shown in FIG. 9, a connector 100 including: a connector housing 103 for receiving terminal fittings 102, attached to ends of electric wires 101; and a seal member 104 to maintain a watertight characteristic between an inner surface of the connector housing 103 and outer surfaces of the electric wires 101 is known (see Japanese Patent Application Laid-Open No. 2000-323229).

The seal member 104 is made of resilient material such as rubber and constructed with a pair of seal bodies 105 and 106, which puts the electric wire 101 therebetween. One end of the seal body 105 and one end of the seal body 106 are connected by a hinge 107. As shown in FIGS. 9 and 10, each seal body 105, 106 has a plurality of grooves 108 each formed in a semi-circle-shape in cross section. The grooves 108 are lined up in parallel to each other. The electric wire 101 is positioned within the grooves 108.

Each seal body 105, 106 is provided with a lip part 110 which projects from an inner surface of the groove 108 toward the inside of the groove 108 in a diameter direction thereof. Because the lip part 110 resiliently comes in contact with an outer periphery of the electric wire 101, therefore the watertight characteristic between the electric wires 101 and inner surfaces of the pair of the seal bodies 105, 106 is maintained. The seal member 104 is press-fit into the connector housing 103 on a condition that the electric wires 101 are placed between the pair of the seal bodies 105 and 106.

As for the seal member 104 of the connector 100, the thickness of the lip part 110 is formed identical throughout the entire region of the lip part 110. That is, the thickness S1 of the lip part 110 in the proximity of an abutting surface 111 between the seal bodies 105 and 106 is formed identical to the thickness 32 of the lip part 110 at a bottom part 112 of the groove 108 being farthest away from the abutting surface 111. In such a construction, because a portion of the lip part 110 near the abutting surface 111 is less resilient than a portion of the lip part 110 at the bottom part 112 of the groove 108, there is a problem in that contact pressure, that is, a sealing characteristic of the lip part 110 against the electric wire 101 in the proximity of the abutting surface 111 becomes small and ineffective.

Moreover, as for the seal member 104, depending on its attaching condition to the connector 100 and size dispersion of the seal member 104, as shown in FIG. 11, there is a problem that a working pitch of the grooves 108 between the seal bodies 105 and 106 might be undesirably displaced. In this case, because the abutting surface 111 positioned in between the grooves 108 adjacent to each other has a small width and low mechanical strength, the abutting surface 111 of the seal body 105, 106 does not abut against an abutting surface 111 of the mating seal body 105, 106 and as shown in FIG. 12, the abutting surface 111 might be undesirably turned up, causing a problem that the sealing characteristic between the abutting surfaces 111 becomes inferior.

SUMMARY OF THE INVENTION

It is therefore an objective of the present invention to solve the above problems and to provide a seal body having an excellent sealing characteristic and a connector including such a seal body.

In order to attain the above objective, the present invention is to provide a seal body which puts an electric wire between the seal body and the other seal body so as to maintain a watertight characteristic between the electric wire and the seal bodies, the seal body including:

an abutting surface of the seal body, which abuts against a mating abutting surface of the other seal body when the seal bodies overlap each other;

a groove which positions the electric wire inside the seal bodies; and a lip part which projects from an inner surface of the groove and from the abutting surface.

With the construction described above, the abutting surfaces can be securely adhere closely to each other, so that the sealing characteristic (sealing strength) between the abutting surfaces can be prevented from deteriorating. Accordingly, the seal body having an excellent sealing characteristic can be provided.

A thickness of the lip part on the abutting surface and a thickness of the lip part on the inner surface of the groove in the proximity of the abutting surface are larger than a thickness of the lip part on the inner surface of a bottom part of the groove.

With the construction described above, the resilient force of the lip part on the abutting surface and in the proximity of the abutting surface can be prevented from becoming smaller than the resilient force of the lip part on the bottom part of the groove. Further, an area of contact between the seal bodies can be large due to the thickness of the lip part in the proximity of the abutting surface. Accordingly, the sealing characteristic between the seal bodies, that is, between the abutting surfaces and the sealing characteristic of the groove in the proximity of the abutting surface can be prevented from deteriorating. Accordingly, the seal body having an excellent sealing characteristic can be provided.

The seal body includes a plurality of the grooves arranged in parallel with each other.

With the construction described above, even when a width of the abutting surface, which is located between the grooves arranged in parallel with each other, is small, the mechanical strength and resilient force of the abutting surface can be increased since the lip part is formed on the abutting surface. Therefore, the abutting surfaces can be securely adhere to each other and the sealing characteristic between the abutting surfaces can be prevented from deteriorating. Accordingly, the seal body having an excellent sealing characteristic can be provided.

In order to attain the above objective, the present invention is also to provide a connector including:

a housing which receives a terminal fitting attached to an end of an electric wire; and a seal member which is attached to the proximity of an aperture of the housing and maintains a watertight characteristic between an inner surface of the housing and the electric wire, wherein the seal member includes a plurality of the seal bodies as described above.

With the construction described above, since the seal member includes the seal bodies having an excellent sealing characteristic, therefore a connector which can securely maintain a watertight characteristic between the inner surface of the housing and the electric wire can be provided.

DESCRIPTION OF THE PREFERRED EMBODIMENTS

First Preferred Embodiment

Figure 1:
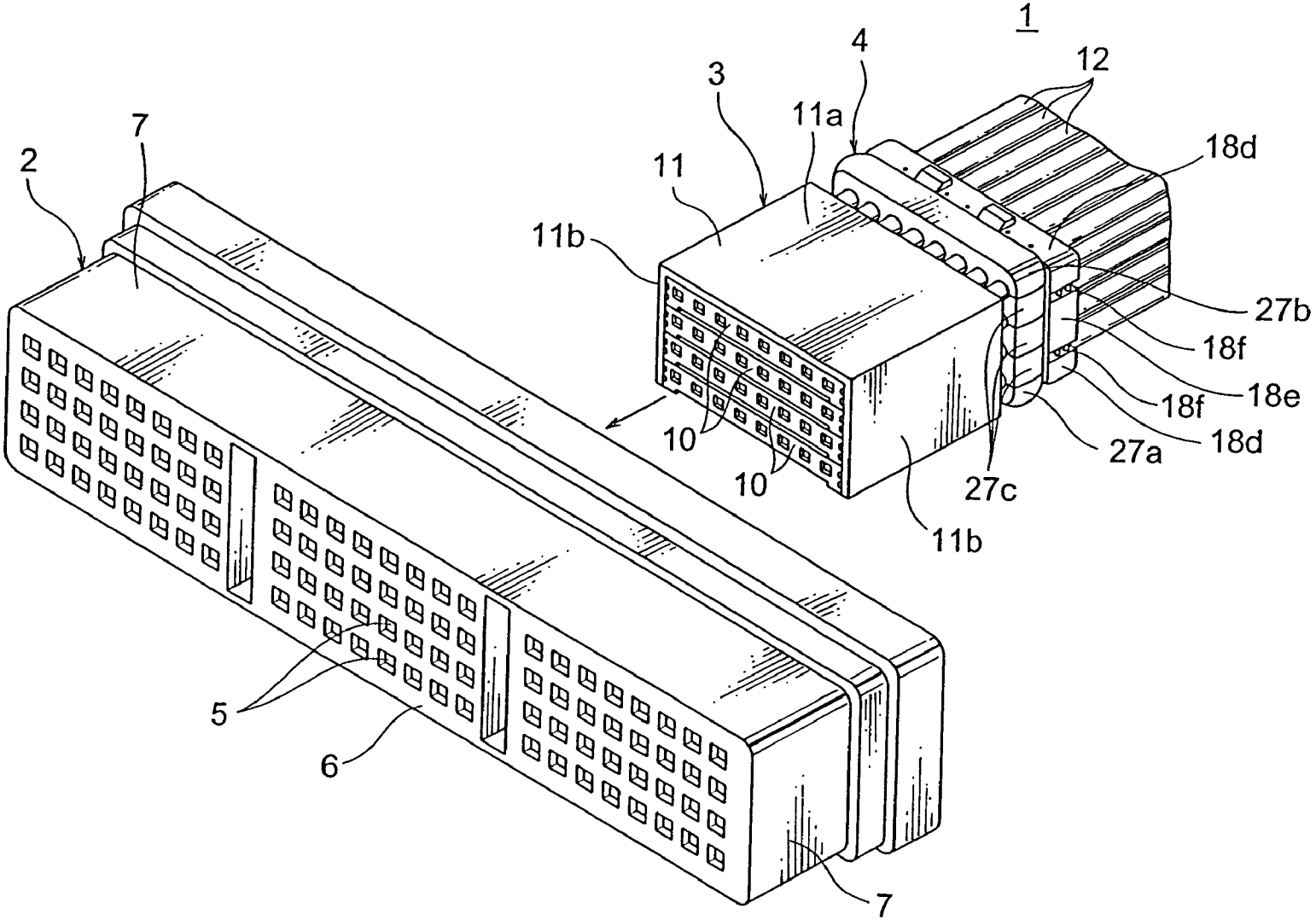
FIG. 1 is a perspective view illustrating a connector according to the first preferred embodiment of the present invention.

In the following, a connector according to the first preferred embodiment of the present invention will be explained with reference to FIGS. 1-7. As shown in FIG. 1, the connector 1 includes an outer housing 2 (i.e. the housing), a plurality of plate-laminated bodies 3, and a plurality of seal members 4.

The outer housing 2 is made of electrically insulating synthetic resin and formed in a tube-shape including a facing wall 6 having a plurality of holes 5 for allowing male terminals of a mating connector, to which the connector 1 fits, to pass, and a plurality of peripheral walls 7 rising up from an outer edges of the facing wall 6. A space within the outer housing 2 is partitioned into plural parts (three parts in an example shown in FIG. 1).

Figure 2:
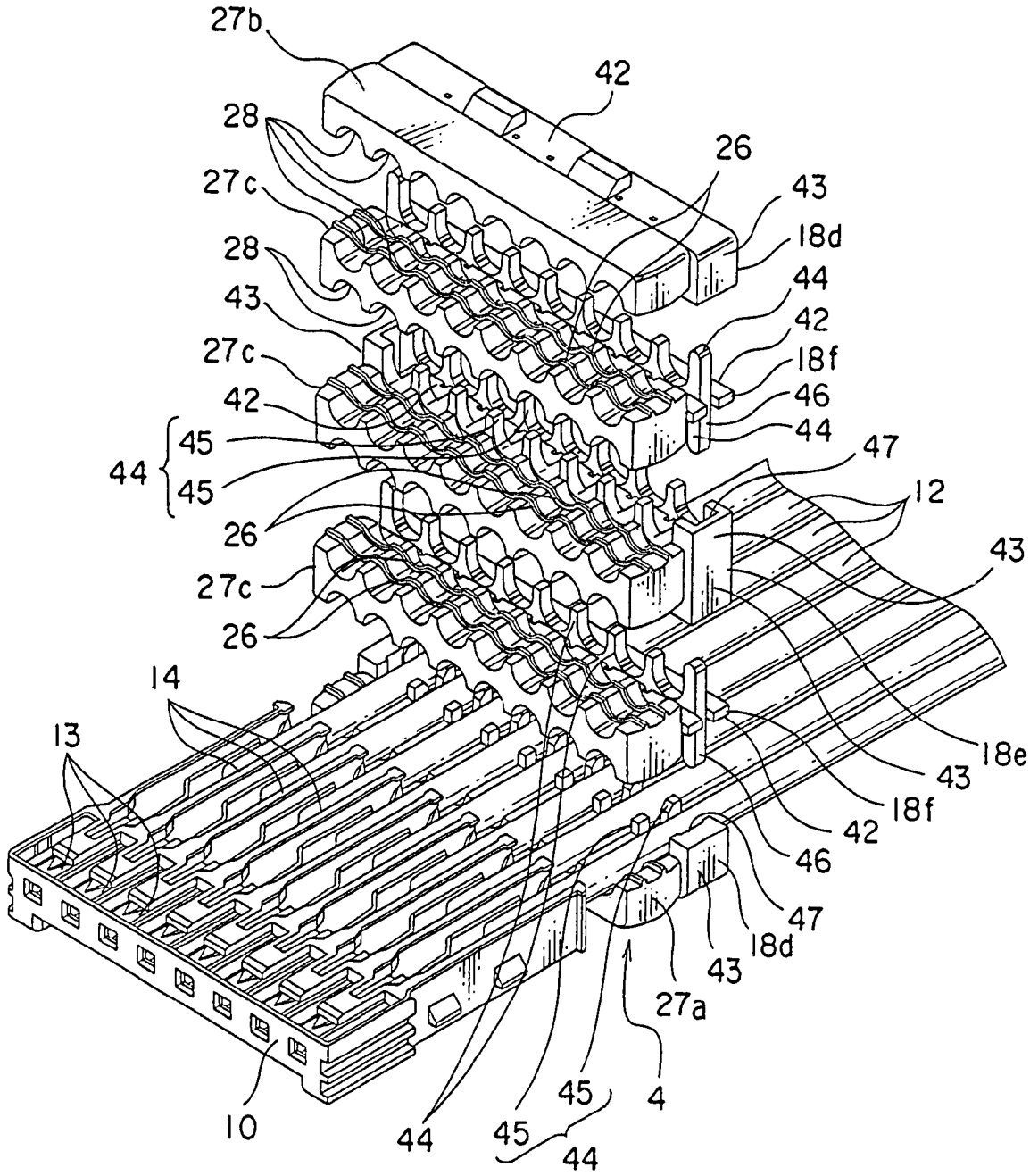
FIG. 2 is an exploded perspective view illustrating a seal member of the connector shown in FIG. 1.
Figure 3:
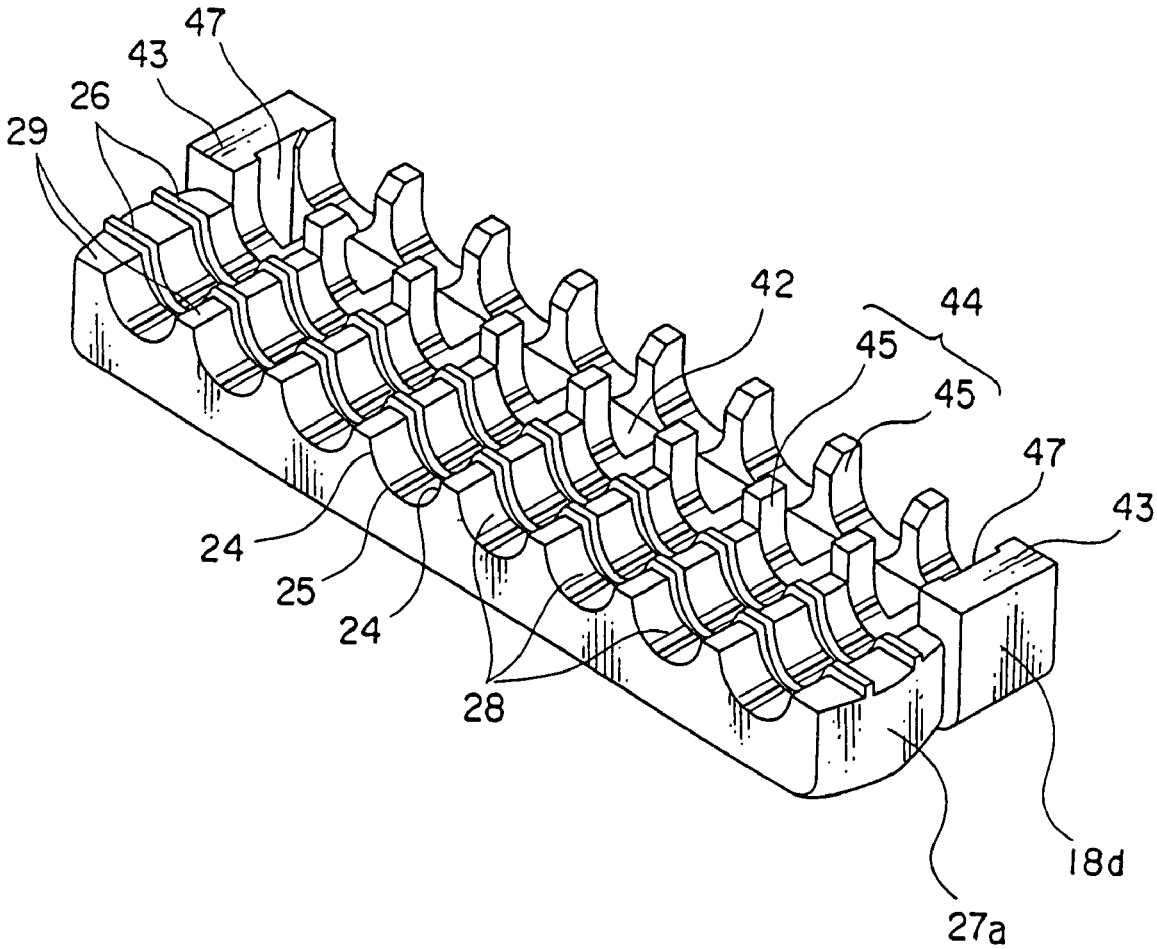
FIG. 3 is a perspective view illustrating a seal body of the seal member shown in FIG. 2.

Three plate-laminated bodies 3 are provided in an example shown in FIG. 1 (only one plate-laminated body 3 being shown in FIG. 1 since the three plate-laminated bodies 3 have the same construction). As shown in FIGS. 1 and 2, the plate-laminated body 3 includes a plurality of plate-shaped housings 10 and a cover member 11. In an example shown in the figure, the plate-laminated body 3 includes four plate-shaped housings 10.

The plate-shaped housing 10 is made of electrically insulating synthetic resin and formed in a flat plate-shape. The plate-shaped housing 10 is provided with a plurality of terminal-receiving chambers 14 for receiving terminal fittings 13 (shown in FIG. 3). A plurality of the terminal-receiving chambers 14 are formed concave from an outer surface of the plate-shaped housing 10 and arranged in parallel with each other. A plurality of the plate-shaped housings 10 are piled up in parallel with one another.

The cover member 11 is made of electrically insulating synthetic resin and formed in a U-shape including a flat ceiling wall 11*a* and rising-up walls 11*b* rising up from outer edges of the ceiling wall 11*a*. The cover member 11 is fixed to the plate-shaped housings 10 in such a manner that the ceiling wall 11*a* is placed on one plate-shaped housing 10 so as to close the terminal-receiving chambers 14 of the one plate-shaped housing 10 that is situated uppermost among a plurality of the plate-shaped housings 10 and the cover member 11 positions a plurality of the plate-shaped housings 10 between the pair of the rising-up walls 11*b*.

Thus, the plate-laminated body 3 is assembled in such a way that the plate-shaped housings 10, into the terminal-receiving chambers of which the terminal fittings 13 attaching the electric wires 12 are received, are piled up one another and the cover member 11 covers the plate-shaped housings 10 so that the plate-shaped housings 10 and the cover member 11 are fixed to one another.

Three seal members 4 are provided in an example shown in FIG. 1 (only one seal member 4 being shown in FIG. 1 since the three seal members 4 have the same construction). As shown in FIG. 2, the seal member 4 is made of hard synthetic resin including: five holders 18*d*, 18*e*, 18*f* (i.e. including two holders 18*d* having the same construction and two holders 18*f* having the same construction) which are piled up one another; and five seal bodies 27*a*, 27*b*, 27*c* (i.e. including three seal bodies 27*c* having the same construction) attached to the five holders 18*d*, 18*e*, 18*f*.

When a plurality of the holders 18*d*, 18*e*, 18*f* are piled up one another, two holders 18*d* situated at both ends of a plurality of the holders 18*d*, 18*e*, 18*f* are formed in the same shape and as shown in FIG. 2, each include a bar-shaped body part 42, a pair of side plate parts 43 rising up in the same direction from both ends in the longitudinal direction of the body part 42, and a plurality of partition parts 44. The partition part 44 rises up from the body part 42 in the same direction as the pair of the side plate parts 43. The partition parts 44 are arranged at regular intervals between the side plate parts 43 and position the electric wire 12 therebetween. The partition part 44 includes a pair of rising-up bars 45 spaced from each other in the longitudinal direction of the electric wire 12.

When a plurality of the holders 18*d*, 18*e*, 18*f* are piled up one another, as shown in FIG. 2, one holder 18*e* situated at the center of a plurality of the holders 18*d*, 18*e*, 18*f* includes, a bar-shaped body part 42, two pairs of side plate parts 43 rising up in both directions from both ends in the longitudinal direction of the body part 42, and a plurality of partition parts 44. The partition parts 44 rise up from the body part 42 in the same direction as the two pairs of the side plate parts 43. The partition parts 44 are arranged at regular intervals between the side plate parts 43 and position the electric wire 12 therebetween. The partition part 44 includes a pair of rising-up bars 45 spaced from each other in the longitudinal direction of the electric wire 12.

As shown in FIG. 2, two holders 18*f* arranged between the holders 18*d* and 18*e* each include a bar-shaped body part 42 and a plurality of partition parts 44. The partition parts 44 rise up from the body part 42 in both directions, are arranged at regular intervals along the longitudinal direction of the body part 42, and position the electric wire 12 therebetween.

Further, the holder 18*f* is provided with positioning bars 46 which project from both ends in the longitudinal direction of the holder 18*f* toward the holders 18*d*, 18*e*. The side plate part 43 of the holder 18*d*, 18*e* is provided with a positioning hole 47. When the positioning bar 46 enters the positioning hole 47, the holders 18*d*, 18*e*, 18*f* piled up one another are positioned with respect to one another.

Each seal body 27*a*, 27*b*, 27*c* is made of resilient material such as rubber. Each seal body 27*a*, 27*b*, 27*c* is formed in a bar-shape and piled up in parallel with one another along the laminating direction of the plate-shaped housings 10. Each seal body 27*a*, 27*b*, 27*c* includes: flat abutting surfaces 29 on which the seal body 27*a*, 27*b*, 27*c* overlaps with another seal body 27*a*, 27*b*, 27*c*; grooves 28 for positioning the electric wires 12 inside; and lip parts 26.

The seal body 27*a* situated lowest in FIG. 2 among a plurality of the seal bodies 27*a*, 27*b*, 27*c* includes the abutting surfaces 29, grooves 28, and lip parts 26 on its surface which faces the other seal body 27*c*. The seal body 27*a* is attached to the holder 18*d* by an adhesive.

The seal body 27*b* situated highest in FIG. 2 among a plurality of the seal bodies 27*a*, 27*b*, 27*c* includes the abutting surfaces 29, grooves 28, and lip parts 26 on its surface which faces the other seal body 27*c*. The seal body 27*b* is attached to the holder 18*d* by an adhesive.

The three seal bodies 27*c* each include the abutting surfaces 29, grooves 28, and lip parts 26 on both its surface which faces the other seal body 27*c* and its surface which faces the seal body 27*a* or 27*b*. The seal body 27*c* is attached to the holder 18*e* or 18*f* by an adhesive.

The groove 28 is formed in an arc-shape in cross section concave from the abutting surface 29. The groove 28 extends straight along the longitudinal direction of the electric wire 12. A plurality of the grooves 28 are arranged spaced from each other in parallel with each other along a direction crossing at right angles the longitudinal direction of the electric wire 12. The grooves 28 and abutting surfaces 29 are arranged alternately.

The lip part 26 is formed projecting from an inner surface of the abutting surface 28 and from the abutting surface 29 throughout the inner surface of the abutting surface 28 and the abutting surface 29. The lip part 26 extends along a direction in which a plurality of the grooves 28 are arranged. The lip part 26 extends thoroughly along a longitudinal direction of the seal body 27*a*, 27*b*, 27*c*. In an example shown in the figure, two lip parts 26 are provided on the abutting surface 29 and the groove 28. A portion of the lip part 26 formed on the abutting surface 29 comes in resilient contact with (or closely adheres to) the lip part 26 of the facing seal body 27*a*, 27*b*, 27*c*. A portion of the lip part 26 formed on the inner surface of the groove 28 comes in resilient contact with (or closely adheres to) an outer periphery of the electric wire 12 which is to be positioned within the grooves 28.

Figure 4:
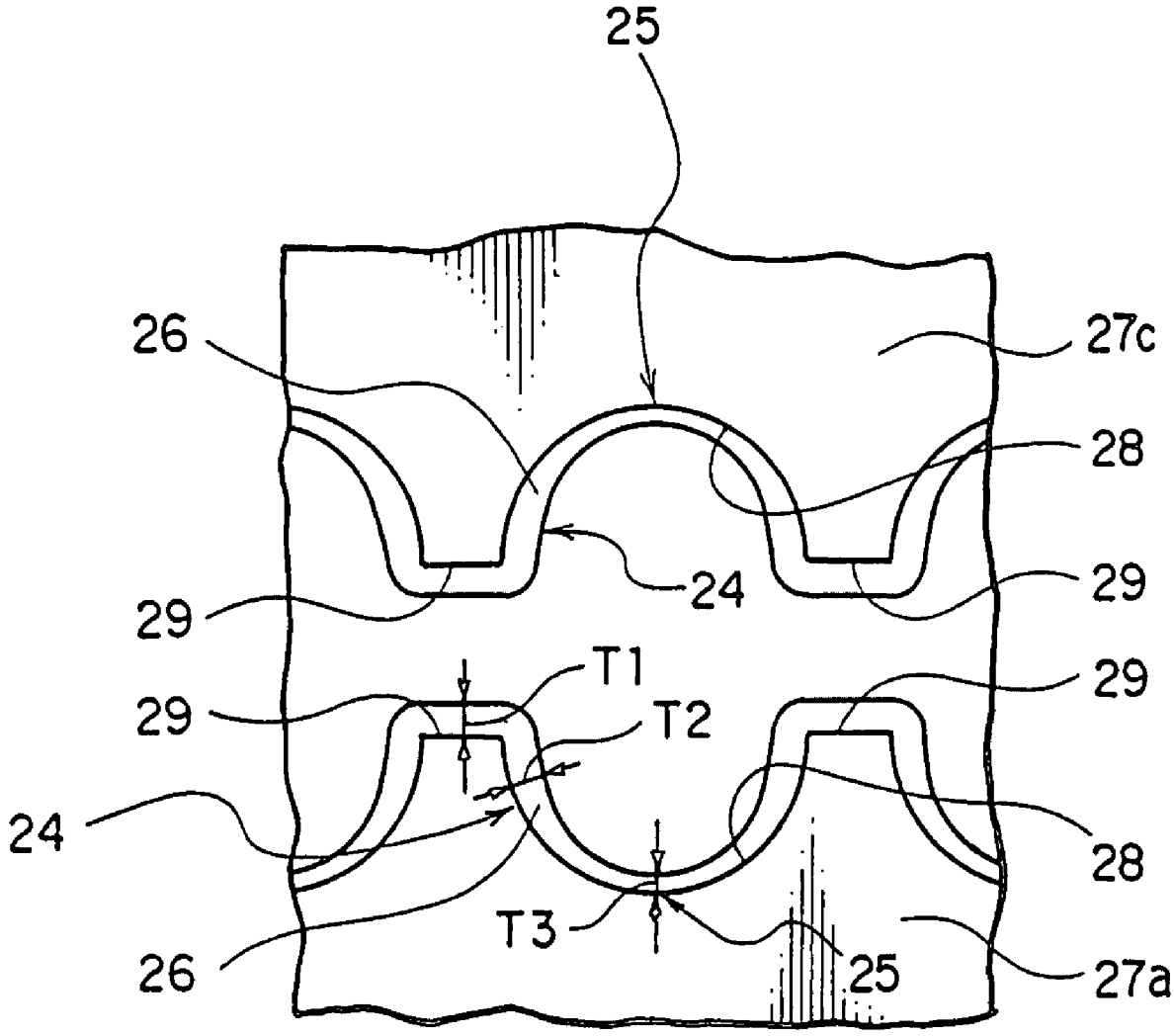
FIG. 4 is an illustration of the seal body of the seal member shown in FIG. 2.

As shown in FIG. 4, a thickness T1 of the lip part 26 on the abutting surface 29 and a thickness T2 of the lip part 26 on the inner surface of the groove 28 in the proximity of the abutting surface 29 are larger than a thickness T3 of the lip part 26 on the inner surface of a bottom part 25 of the groove 28. Here, the bottom part 25 means a portion of the groove 28, said portion being located farthest away from the butting surface 29.

Figure 5:
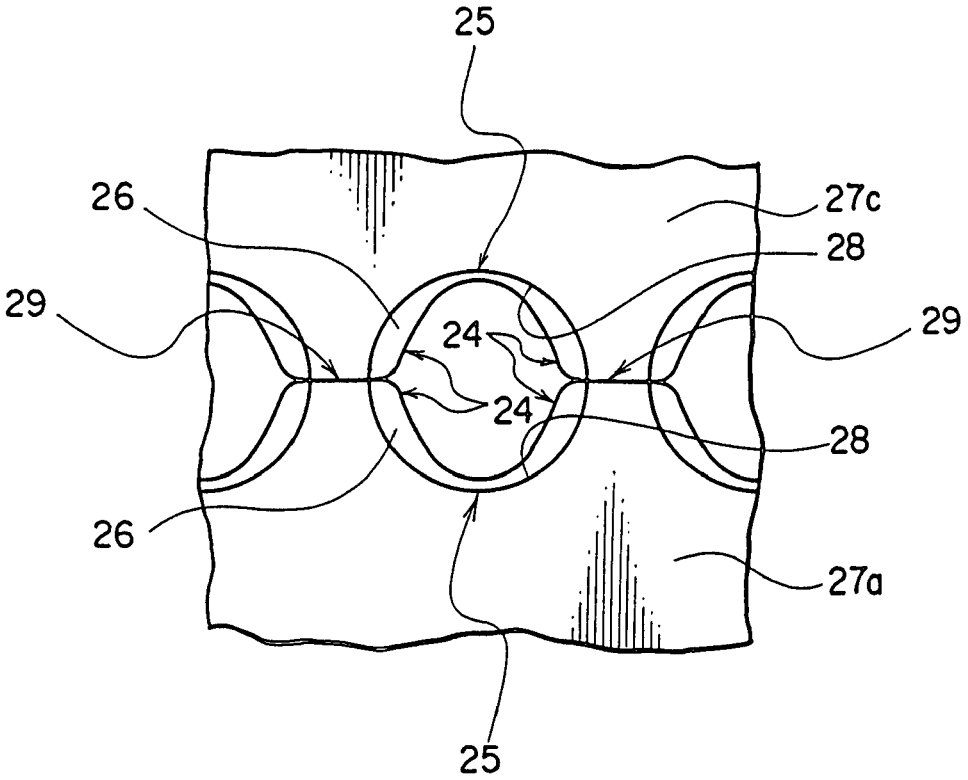
FIG. 5 is an illustration of the seal body of the seal member shown in FIG. 2, illustrating a state when the seal bodies shown in FIG. 4 overlap one another.

When seal bodies 27*a*, 27*b* and 27*c* are piled up one another, as shown in FIG. 5, the seal bodies 27*a*, 27*b* and 27*c* closely adhere to one another in such a manner that the lip parts 26 formed on the respective abutting surfaces 29 are crushed with each other. Since the thickness of a portion 24 of the lip part 26 in the proximity of the abutting surface 29 is larger than the thickness of the lip part 26 on the inner surface of the bottom part 25 of the groove 28, therefore the portion 24 of the lip part 26 closely adhere to the electric wire 12, which is to be positioned within the groove 28, with a high contact pressure.

That is, in the present invention, the lip part 26 is formed on the abutting surface 29 so that a sealing characteristic among the seal bodies 27*a*, 27*b* and 27*c*, i.e. between the abutting surfaces 29 is improved. Moreover, the portion 24 of the lip part 26 in the proximity of the abutting surface 29 is formed thick so that the contact pressure of the lip part 26 on the inner surface of the groove 28 against the electric wire 12 becomes uniform throughout the entire periphery of the electric wire 12.

Figure 6:
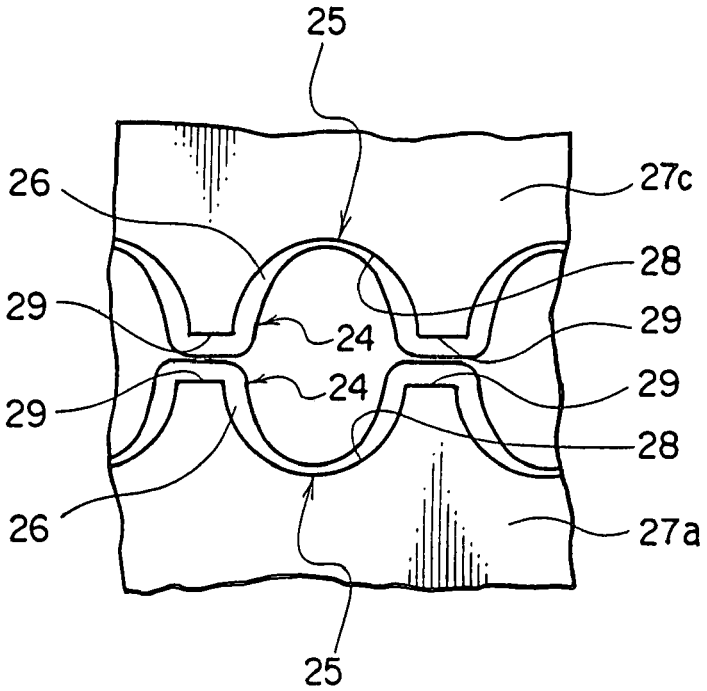
FIG. 6 is an illustration of the seal body of the seal member shown in FIG. 2, illustrating a state when the pitches of the grooves of the seal bodies are different from each other.
Figure 7:
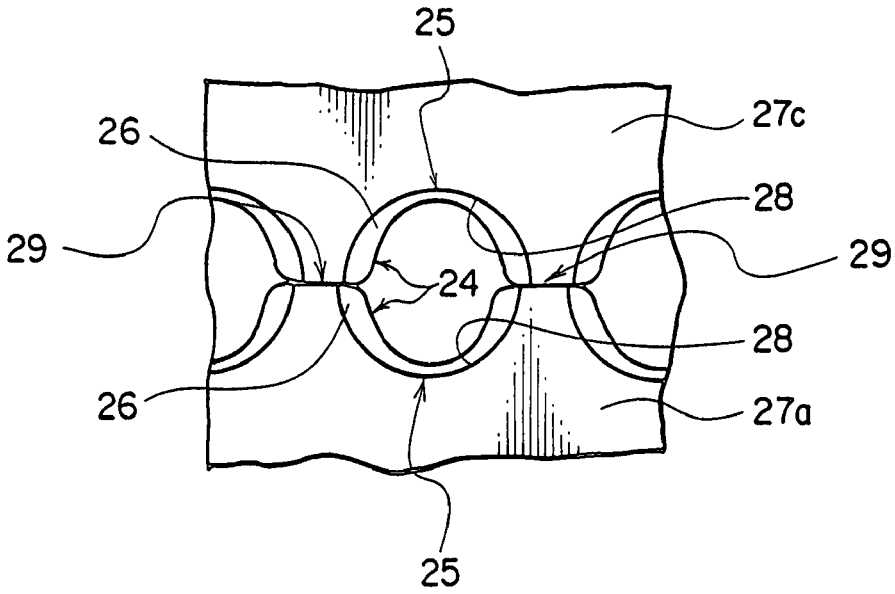
FIG. 7 is an illustration of the seal body of the seal member shown in FIG. 2, illustrating a state when the seal bodies shown in FIG. 5 overlap one another.

Even if the pitches of the seal bodies 27*a*, 27*b* and 27*c* facing each other do not match with each other due to the size dispersion as shown in FIG. 6, since the portion 24 of the lip part 26 in the proximity of the abutting surface 29 is formed thick, the contact area among the seal bodies 27*a*, 27*b* and 27*c* facing each other is set large, therefore as shown in FIG. 7, the seal bodies 27*a*, 27*b* and 27*c* closely adhere to each other, that is, the abutting surfaces 29 facing each other closely adhere to each other, so that the sealing characteristic among the seal bodies 27*a*, 27*b* and 27*c*, i.e. between the abutting surfaces 29 can be prevented from deteriorating. That is, a mismatch between the pitches of the grooves 28 can be absorbed.

The connector 1 described above is assembled as follows. First, the terminal fitting 13 attaching the electric wire 12 is press-fit into the terminal-receiving chamber 14 of the plate-shaped housing 10. Then, as shown in FIG. 2, the electric wire 12 of one plate-shaped housing 10 is positioned within the groove 28 of the seal body 27*a* and between the partition parts 44 of the holder 18*d*. Then, the seal body 27*c* and the holder 18*f* are placed on the electric wire 12. Then, the electric wire 12 of another plate-shaped housing 10 is placed on the seal body 27*c* and the holder 18*f*. In such a manner, the other seal bodies 27*c* and 27*b* and the holders 18*e*, 18*f* and 18*d* are placed on (i.e. piled on) the electric wire 12, thereby assembling the seal member 4.

Thereafter, the cover member 11 is attached on a plurality of the plate-shaped housings 10 piled up one another so as to fix a plurality of is the plate-shaped housings 10 to one another, so that the plate-laminated body 3 is assembled. Then, after the assembled plate-laminated body 3 is inserted in the outer housing 2, the assembled seal member 4 is press-fit into the proximity of the aperture of the outer housing 2. Thus, each seal body 27*a*, 27*b*, 27*c* of the seal member 4 maintains the watertight characteristic between the inner surface of the outer housing 2 and the electric wire 12, so that the connector 1 is assembled.

Further, the connector 1 assembled as described above is coupled with a mating connector so as to construct a wiring harness to be mounted on a motor vehicle and so on.

According to the preferred embodiment described above, the lip part 26 is formed on the abutting surface 29, so that the sealing characteristic between the abutting surfaces 29 can be prevented from deteriorating. Moreover, the thickness of the portion 24 of the lip part 26 in the proximity of the abutting surface 29 is larger than the thickness of the lip part 26 on the inner surface of the bottom part 25 of the groove 28, so that the sealing characteristic of the portion 24 of the lip part 26 in the proximity of the abutting surface 29 can be prevented from deteriorating and the contact area among the seal bodies 27*a*, 27*b* and 27*c* facing each other can be large, therefore the sealing characteristic among the seal bodies 27*a*, 27*b* and 27*c*, i.e. between the abutting surfaces 29 can be prevented from deteriorating.

Since the seal bodies 27*a*, 27*b* and 27*c* are in advance attached to the respective holders 18*e*, 18*f* and 18*d* by an adhesive, therefore even if the resilient restoring force occurs when the holders 18*e*, 18*f* and 18*d* are attached to each other, the seal bodies 27*a*, 27*b* and 27*c* can be prevented from coming off from the holders 18*e*, 18*f* and 18*d*. Therefore, the seal member 4 can be easily assembled.

Further, as for the seal member 4, since a positional relation among the holders 18*e*, 18*f* and 18*d*, that is, a positional relation among the seal bodies 27*a*, 27*b* and 27*c* can be always maintained constant by the positioning bar 46 and the positioning hole 47, therefore the watertight characteristic between the seal bodies 27*a*, 27*b*, 27*c* and the electric wire 12 can be securely attained, that is, liquid such as water can be securely prevented from entering the connector 1.

Second Preferred Embodiment

In the following, a seal member constituting a connector according to the second preferred embodiment of the present invention will be explained with reference to FIG. 8.

Figure 8:
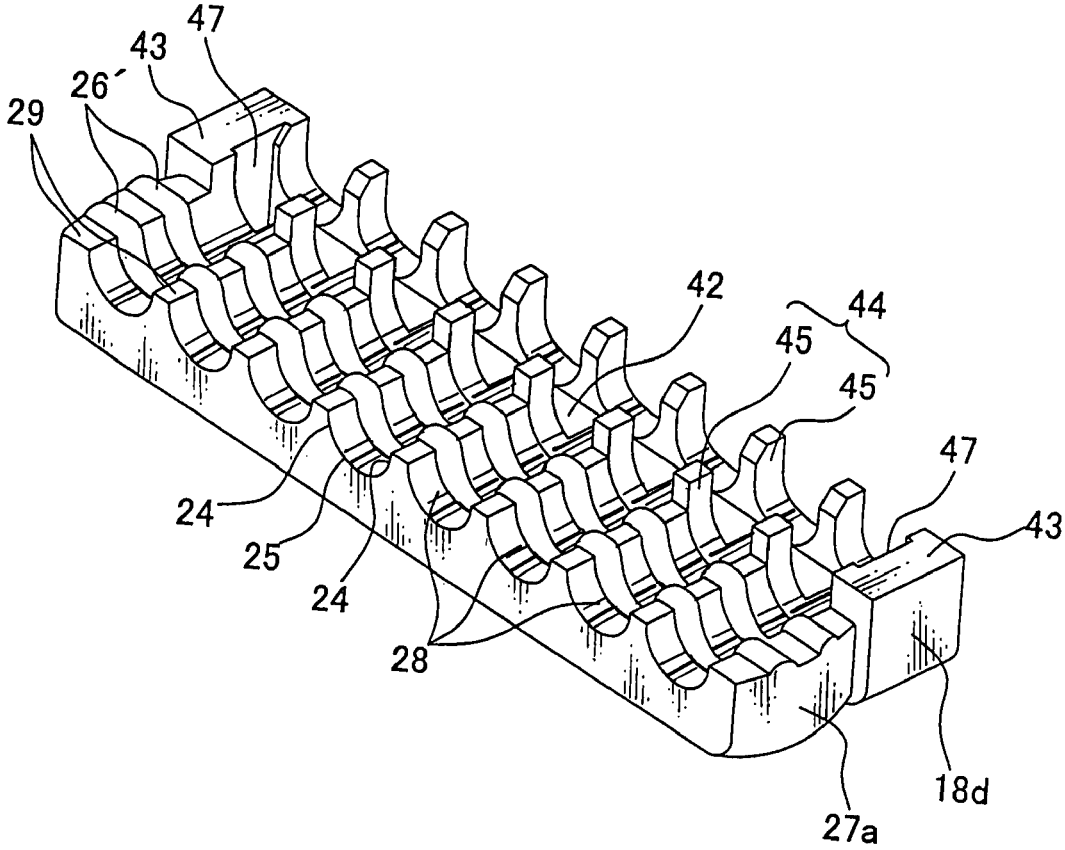
FIG. 8 is a perspective view illustrating a seal member constituting a connector according to the second preferred embodiment of the present invention.
Figure 9:
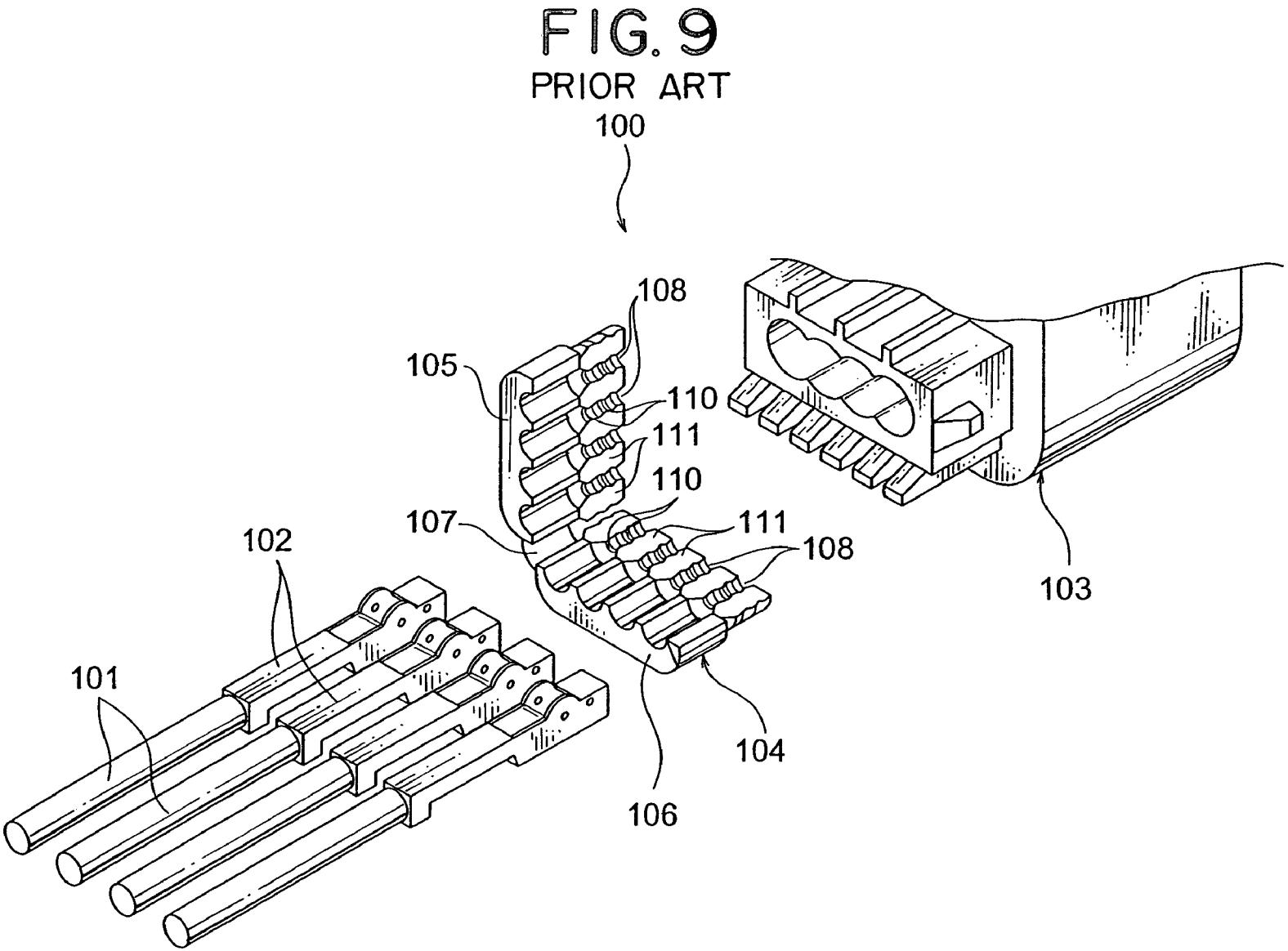
FIG. 9 PRIOR ART
FIG. 9 is a perspective view illustrating a connector having conventional seal bodies.
Figure 10:
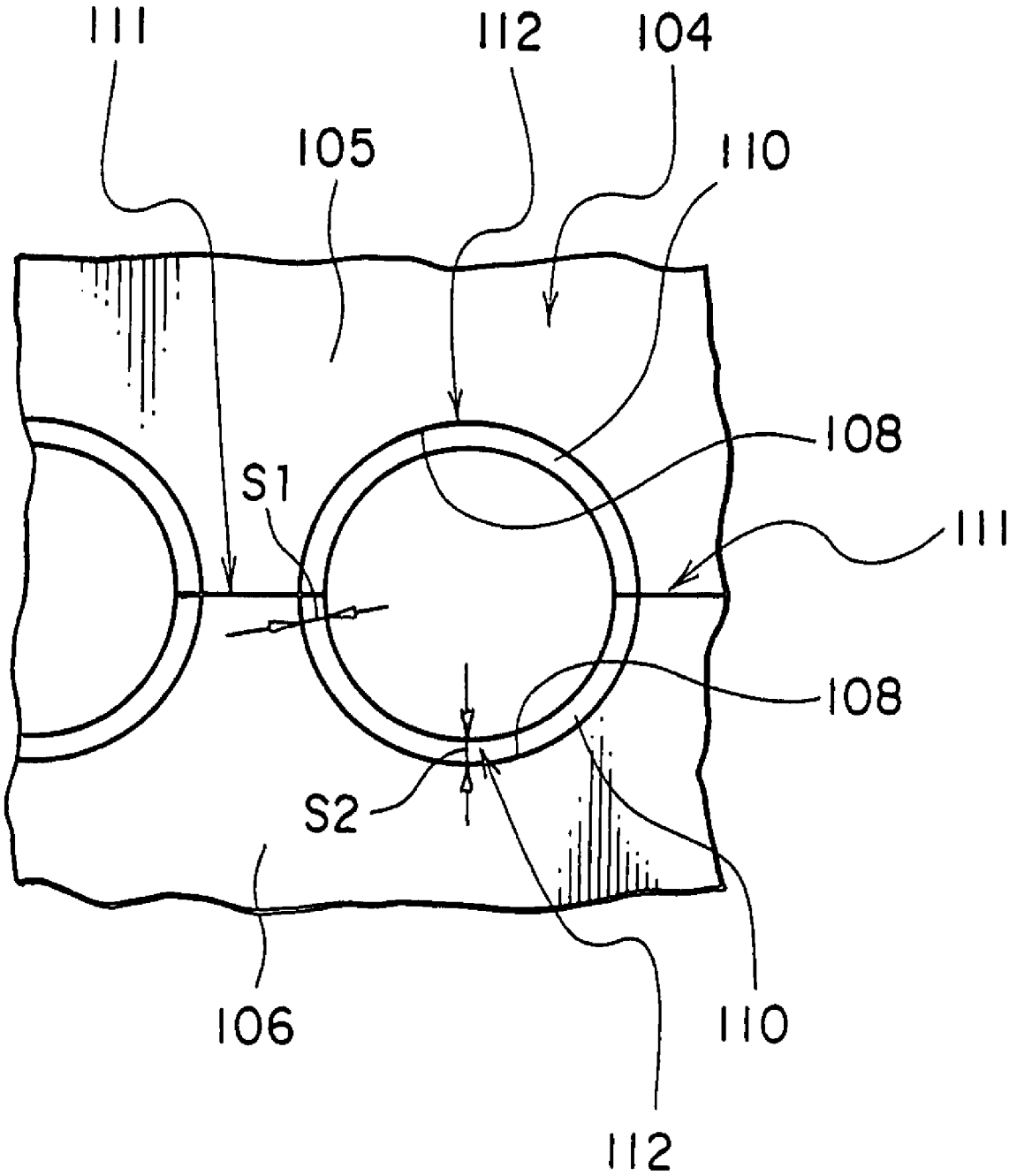
FIG. 10 PRIOR ART
FIG. 10 is a view explaining a problem of the conventional seal bodies shown in FIG. 9.
Figure 11:
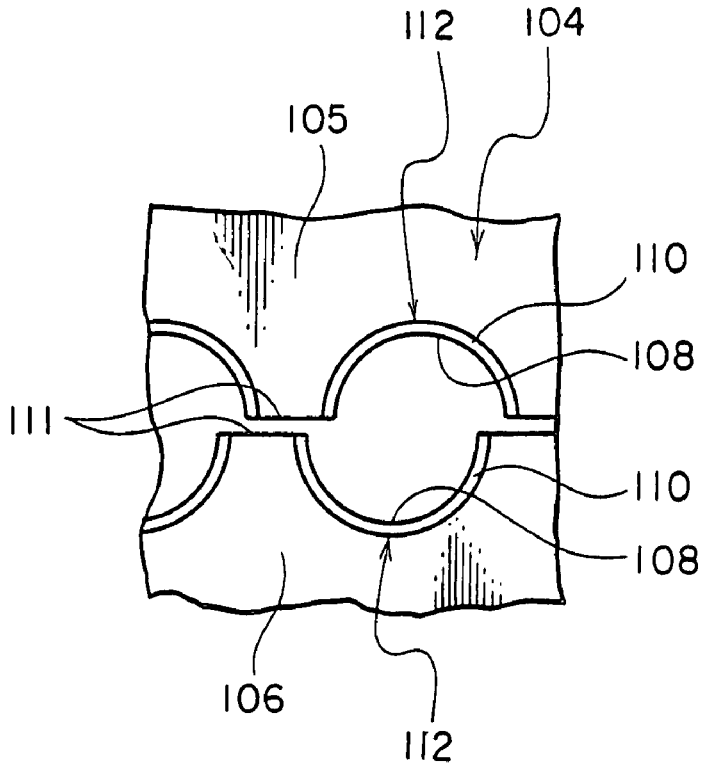
FIG. 11 PRIOR ART
FIG. 11 is a view explaining a problem of the conventional seal bodies shown in FIG. 9, illustrating a state when the pitches of the grooves of the conventional seal bodies are different from each other.
Figure 12:
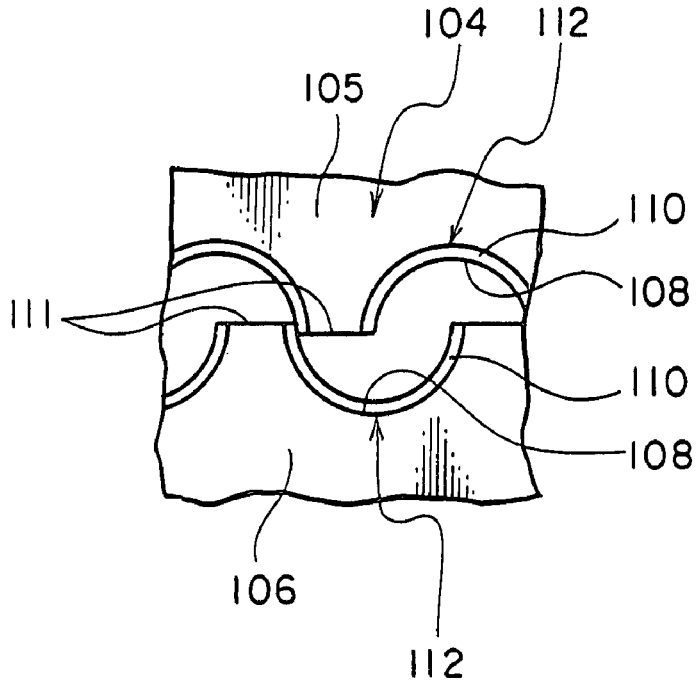
FIG. 12 PRIOR ART
FIG. 12 is a view explaining a problem of the conventional seal bodies shown in FIG. 9, illustrating a state when the conventional seal bodies shown in FIG. 11 overlap one another.

As shown in FIG. 8, each of seal bodies 27*a*, 27*b* and 27*c* according to the second preferred embodiment includes a lip part 26' instead of the lip part 26 of the seal body 27*a*, 27*b*, 27*c* according to the first preferred embodiment (only the seal body 27*a* being shown in FIG. 8). A width of the lip part 26' along the longitudinal direction of the wire 12 is formed larger than that of the lip part 26. Therefore, the resilient force of the lip part 26' is larger than that of the lip part 26. Similarly to the lip part 26, a thickness of the lip part 26' on the abutting surface 29 and a thickness of the lip part 26' on the inner surface of the groove 28 in the proximity of the abutting surface 23 are formed larger than a thickness of the lip part 26' on the inner surface of a bottom part 25 of the groove 28.

The sealing characteristic between the sealing body 27*a*, 27*b*, 27*c* according to the second preferred embodiment including such a lip part 26' and the other sealing body 27*a*, 27*b*, 27*c* including such a lip part 26', that is, the sealing characteristic between the abutting surfaces 29 is higher than that in the first preferred embodiment.

Thus, in the present invention, the degree of the sealing characteristic can be adjusted by changing the width of the lip part 26, 26'. Moreover, in the present invention, the degree of the sealing characteristic can also be adjusted by changing the number of the lip parts 26, 26'.

Further, for example, when the width of the lip part 26, 26' is small, there is a possibility that the lip parts 26, 26' might buckle with each other when the sealing bodies 27*a*, 27*b*, 27*c* are placed one upon another. However, by making the width of the lip part 26' large as shown in the second preferred embodiment, the lip parts 26, 26' can be securely prevented from buckling with each other when the sealing bodies 27*a*, 27*b*, 27*c* are placed one upon another.

The aforementioned preferred embodiments are described to aid in understanding the present invention and variations may be made by one skilled in the art without departing from the spirit and scope of the present invention.

What is claimed is:

1. A seal body apparatus which places an electric wire between a first seal body and a second seal body so as to maintain a watertight characteristic between the electric wire and the first and second seal bodies, the seal body apparatus comprising:

an abutting surface of the first seal body, which abuts against a mating abutting surface of the second seal body when the first and second seal bodies overlap each other;

a groove which positions the electric wire inside the first and second seal bodies; and a continuous lip part which projects from an inner surface of the groove and from the abutting surface.

2. The seal body apparatus according to claim 1, wherein a vertical thickness of the lip part on the abutting surface and a vertical thickness of the lip part on the inner surface of the groove in the proximity of the abutting surface are both greater than a vertical thickness of the lip part on the inner surface of a bottom part of the groove.

3. The seal body apparatus according to claim 1, wherein each of the first and second seal bodies comprises a plurality of the grooves arranged in parallel with each other.

4. The seal body according to claim 2, wherein each of the first and second seal bodies comprises a plurality of the grooves arranged in parallel with each other.

5. A connector comprising:

a housing which receives a terminal fitting attached to an end of an electric wire; and a seal member which is attached to the proximity of an aperture of the housing and maintains a watertight characteristic between an inner surface of the housing and the electric wire, wherein the seal member includes a plurality of the first and second seal bodies according to claim 1.

6. A connector comprising:

a housing which receives a terminal fitting attached to an end of an electric wire; and a seal member which is attached to the proximity of an aperture of the housing and maintains a watertight characteristic between an inner surface of the housing and the electric wire, wherein the seal member includes a plurality of the first and second seal bodies according to claim 2.

7. A connector comprising:

a housing which receives a terminal fitting attached to an end of an electric wire; and a seal member which is attached to the proximity of an aperture of the housing and maintains a watertight characteristic between an inner surface of the housing and the electric wire, wherein the seal member includes a plurality of the first and second seal bodies according to claim 3.

8. A connector comprising:

a housing which receives a terminal fitting attached to an end of an electric wire; and a seal member which is attached to the proximity of an aperture of the housing and maintains a watertight characteristic between an inner surface of the housing and the electric wire, wherein the seal member includes a plurality of the first and second seal bodies according to claim 4.

* * * * *